US007178741B2

(12) United States Patent
Sheng-Chih et al.

(10) Patent No.: US 7,178,741 B2
(45) Date of Patent: Feb. 20, 2007

(54) MICRO DROPLET GENERATOR

(75) Inventors: Shen Sheng-Chih, Sinying (TW); Wang Yu-Ran, Banciao (TW); Liou Shun-Nan, Kaohsiung (TW); Yeh Chien-Shien, Yongkang (TW); Chen Yi-Chang, Jhonghe (TW); Pan I-Kai, Kaohsiung (TW); Lee Chung-Jui, Hsinchu (TW); Tsai Ming-Jye, Sinpu Township, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 205 days.

(21) Appl. No.: 10/918,026

(22) Filed: Aug. 11, 2004

(65) Prior Publication Data

US 2006/0032941 A1 Feb. 16, 2006

(51) Int. Cl.
*B05B 1/08* (2006.01)

(52) U.S. Cl. ..... 239/102.2; 239/102.1; 239/589.1; 239/590.3; 239/596; 128/200.14; 128/200.16

(58) Field of Classification Search ..... 239/43, 239/51.5, 102.1, 589.1, 590.3, 596, 102.2; 128/200.14, 200.16, 203.12
See application file for complete search history.

(56) References Cited

U.S. PATENT DOCUMENTS

| | | | | | |
|---|---|---|---|---|---|
| 4,294,407 | A * | 10/1981 | Reichl et al. | ..... | 239/102.2 |
| 4,479,609 | A * | 10/1984 | Maeda et al. | ..... | 239/102.2 |
| 5,297,734 | A * | 3/1994 | Toda | ..... | 239/102.2 |
| 5,485,828 | A * | 1/1996 | Hauser | ..... | 128/200.16 |
| 5,657,926 | A * | 8/1997 | Toda | ..... | 239/102.2 |
| 5,996,903 | A * | 12/1999 | Asai et al. | ..... | 239/4 |
| 2003/0062038 | A1 * | 4/2003 | Tanaka et al. | ..... | 128/200.14 |

* cited by examiner

*Primary Examiner*—Kevin Shaver
*Assistant Examiner*—Jason Boeckmann
(74) *Attorney, Agent, or Firm*—W. Wayne Liauh

(57) ABSTRACT

Disclosed is a micro droplet generator which comprises a lower space for containing a control panel, and an upper chamber for containing fluid medicine and including an nebulized area formed on a joining portion of the space and thereof. On the nebulized area there are provided an outer nozzle plate including tapered apertures and a piezoelectric element electrically coupled to the control panel. Activating the piezoelectric element will vibrate it to sufficiently mix the liquid medicine for developing fluid cavitation in the nebulized area, forms a stream of droplets from small particles of the fluid medicine and ejects the same therefrom, condenses the large particles of the fluid medicine due to collision therebetween, and drops the condensed liquid into the fluid medicine. Also, any malfunctioned component can be replaced individually.

6 Claims, 7 Drawing Sheets

MICRO DROPLET GENERATOR

FIELD OF THE INVENTION

The present invention relates to liquid spray devices and more particularly to a micro droplet generator suitable for medical spray application.

BACKGROUND OF THE INVENTION

Liquid atomizers have a wide variety of applications. For curing diseases, typically a patient has to swallow pills or a medical worker injects liquid medicine into the patient. For the former, it is relatively simple but drug absorption needs a relatively long period of time (e.g., half hour or more). For the latter, the drug absorption time is short so that curing effect can be quickly seen. But the patient has to suffer the pain of needle injection on his/her body. As for medicine spray devices, they have advantages of the above both while without their disadvantages. Thus, medical spray devices have a bright future as agreed by most medical practitioners.

A conventional medicine spray device (e.g., atomizer) is used to shoot out a fine spray of medicine into the mouth of a patient. The nebular droplets then enter into the body of the patient for being absorbed through the lungs. However, the prior atomizers suffered from several disadvantages. For example, the spray of medicine is not acceptably fine, resulting in a poor absorption effect.

There are two types of medical atomizers commercially available. One is pressurized atomization type which requires a great pressure to atomize liquid medicine and thus consumes a lot of energy and generates noise. Moreover, the particle size of spray is an important factor in considering the buying of an atomizer by medical practitioners. Thus, the application of such type of medical atomizers is very limited because it can easily generate large particles in the spray.

The other type is mechanical vibration type which utilizes one or more piezoelectric elements to generate droplets. It is the dominant type of medical atomizer despite of drawbacks (e.g., high energy consumption, different sizes of the nebular particles, the installation of an additional fan, and bulkiness) thereof. For overcoming these drawbacks, piezoelectric elements and planar elements are incorporated into the mechanical vibration type of medical atomizer by some manufacturers. For example, U.S. Pat. No. 6,629,646 discloses a fluid ejection device as shown in FIGS. 1 and 2. The fluid ejection device comprises a cantilever beam 1 including a base portion affixed to a piezoelectric oscillator 2 and a free end provided with a planar surface 3 through which there are a plurality of microscopic tapered apertures 4. Fluid is in contact with the free end through which droplets are ejected from the aperture 4.

However, the patent still suffered from a couple of disadvantages. For example, the fixing of the piezoelectric oscillator 2 and the planar surface 3 on the beams 1 is hard to be secured, resulting in a shortened useful time and poor atomization effect. Moreover, a user has to replace all of the piezoelectric oscillator 2, the planar surface 3, and the beam 1 even if only either the piezoelectric oscillator 2 or the planar surface 3 is malfunctioned. This is not cost effective. Thus, continuing improvements in the exploitation of medical atomizers are constantly being sought.

SUMMARY OF THE INVENTION

It is an object of the present invention to provide a portable micro droplet generator comprising a lower space for containing a control panel, and an upper chamber for containing fluid medicine and including an nebulized area formed on a joining portion of the space and thereof, wherein on the nebulized area there are provided an outer nozzle plate including a plurality of tapered apertures each having a small outer opening and a large inner opening, and a piezoelectric element electrically coupled to the control panel such that activating the piezoelectric element will vibrate the piezoelectric element to sufficiently mix the liquid medicine therearound for developing fluid cavitation in the nebulized area, forms a stream of droplets from smaller particles of the fluid medicine and ejects the same therefrom, condenses larger particles of the fluid medicine due to collision therebetween, and drops the condensed liquid into the fluid medicine.

In one aspect of the present invention, there is further provided a frame formed between the nozzle plate and the piezoelectric element, and wherein the piezoelectric element is cantilevered by driving one or more fasteners through the frame and the piezoelectric element into the chamber.

In another aspect of the present invention, the control panel comprises an IC based controller for actuating the piezoelectric element, and a battery for providing power to the controller.

In yet another aspect of the present invention, there is further provided a hollow pad adhered to the nozzle plate for buffering so as to facilitate the droplet ejection.

In a further aspect of the present invention, any malfunctioned component of the generator can be replaced individually so as to save its maintenance cost.

The above and other objects, features and advantages of the present invention will become apparent from the following detailed description taken with the accompanying drawings.

DETAILED DESCRIPTION OF THE PREFERRED EMBODIMENTS

Figure 1:
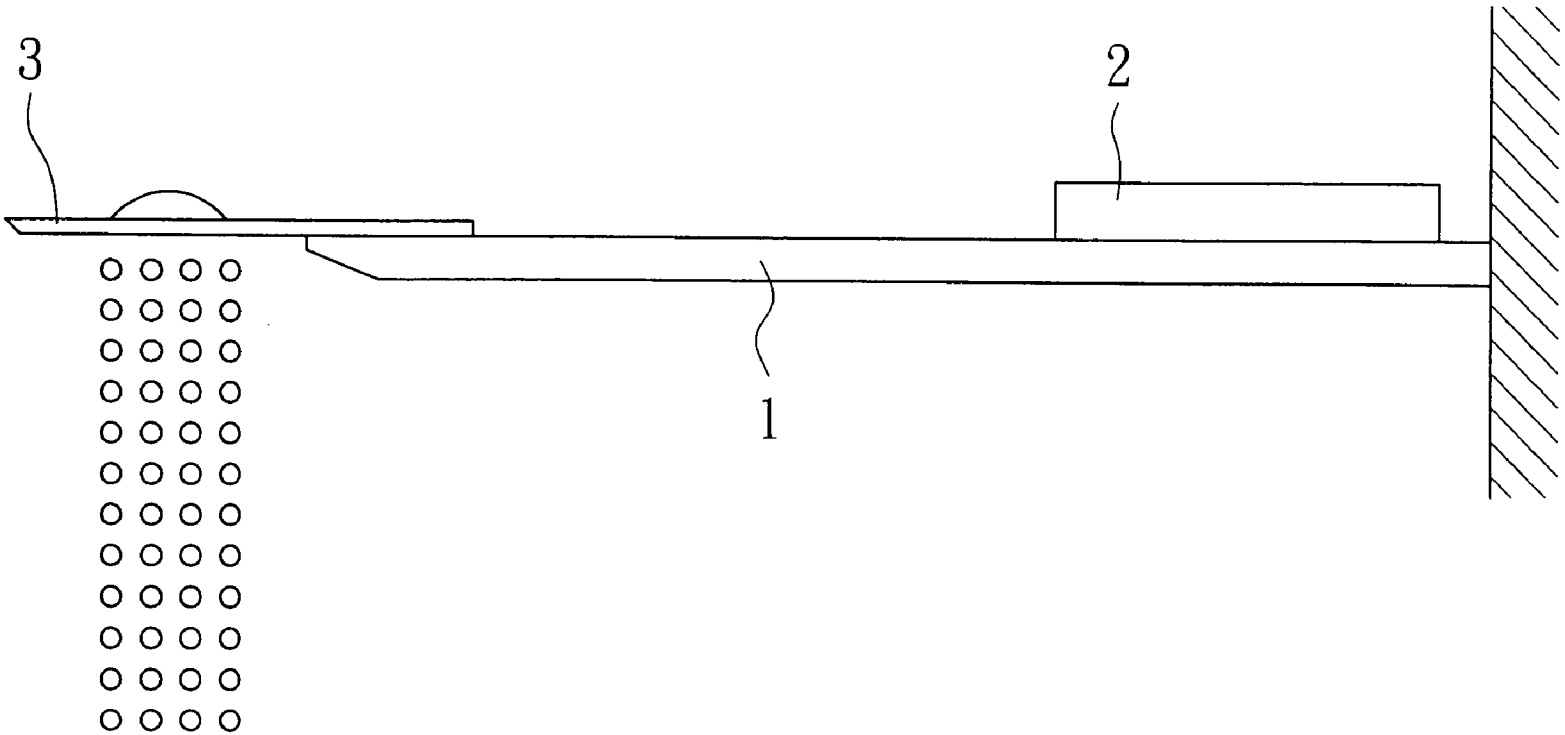
FIG. 1 PRIOR ART
FIG. 1 is a side plan view of a prior fluid ejection device disclosed in U.S. Pat. No. 6,629,646.
Figure 2:
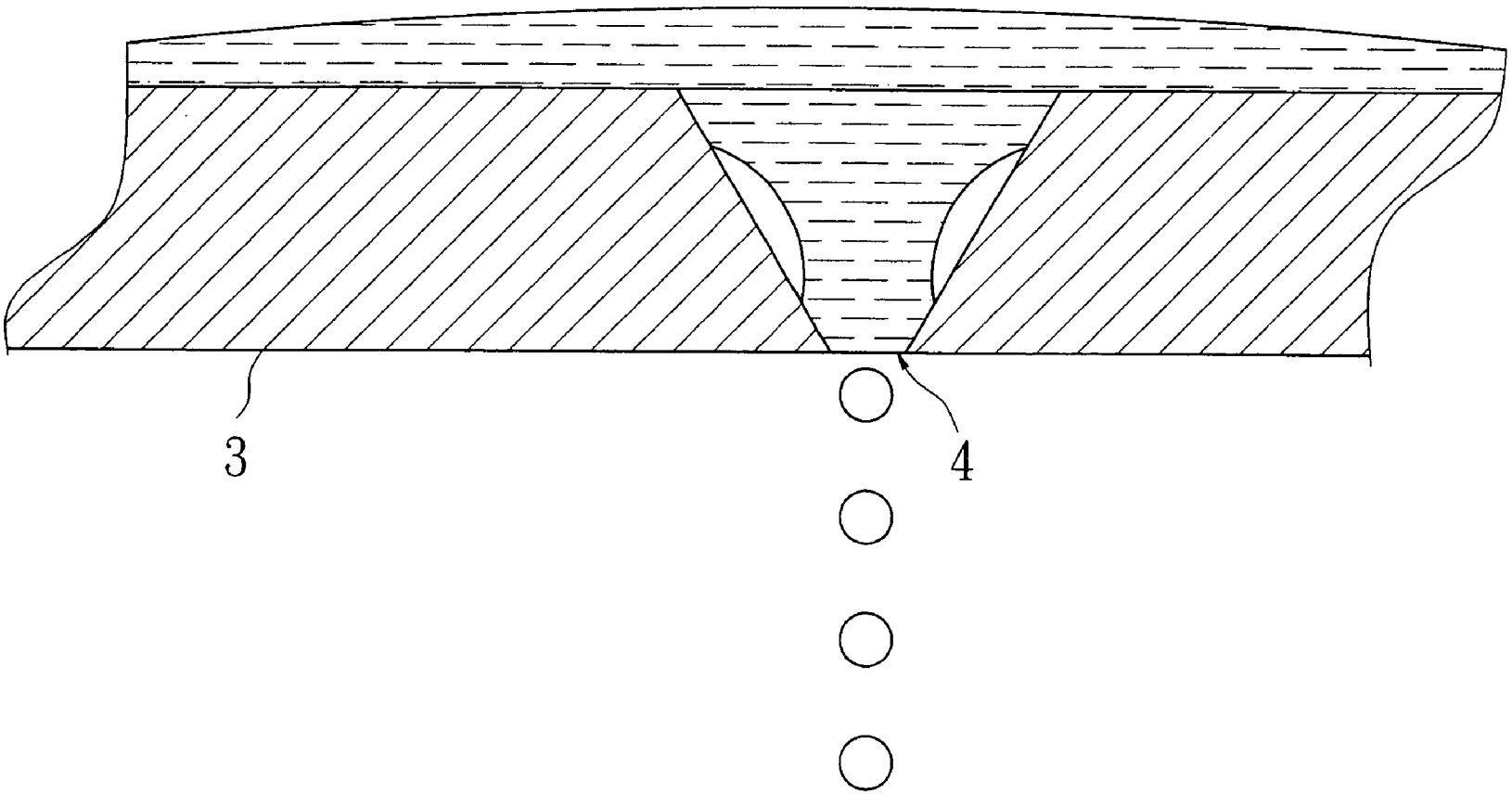
FIG. 2 PRIOR ART
FIG. 2 is a greatly enlarged sectional view of one of apertures formed in the planar surface.
Figure 3:
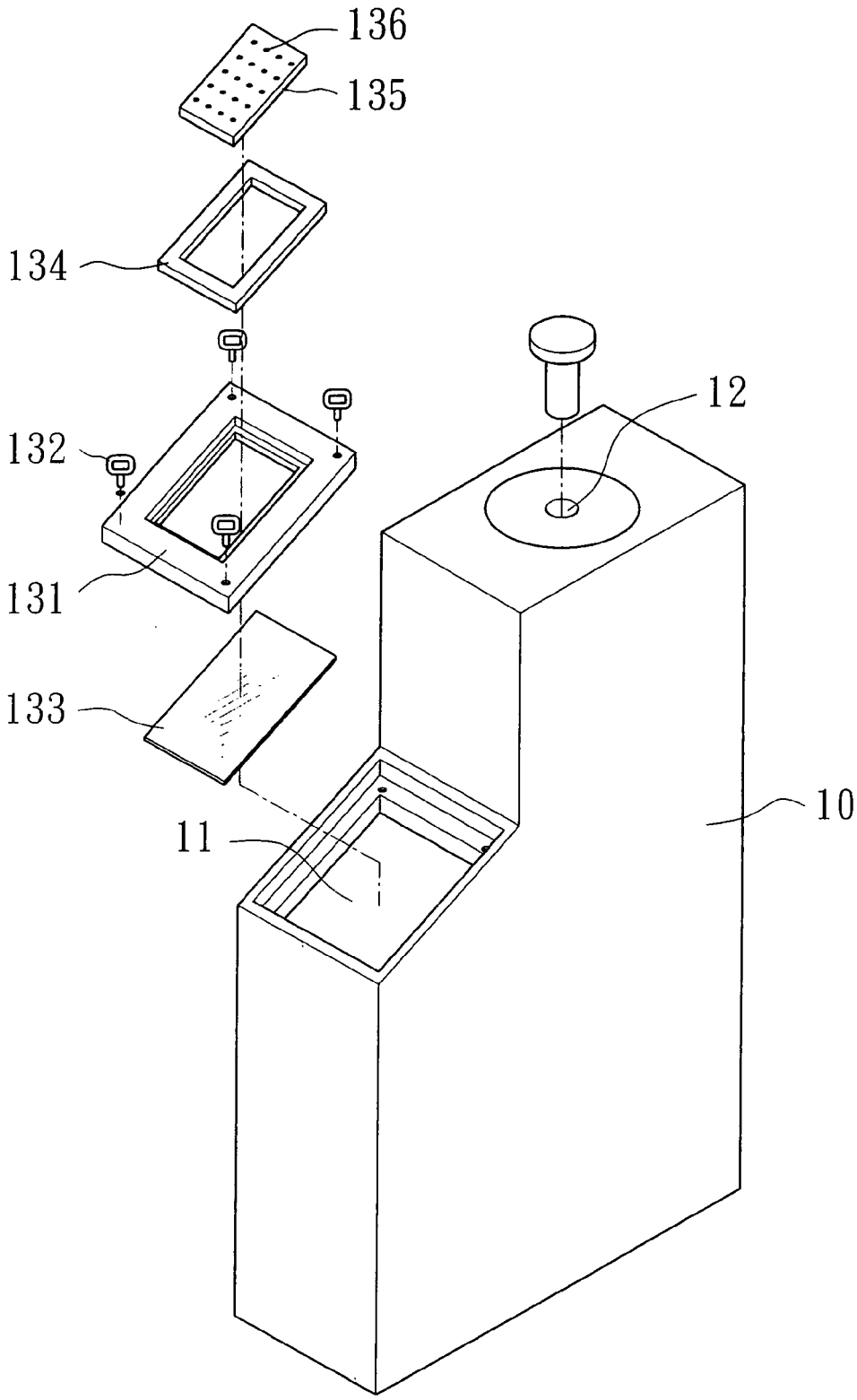
FIG. 3 is an exploded view of major components in a nebulized area of micro droplet generator according to the invention.
Figure 4:
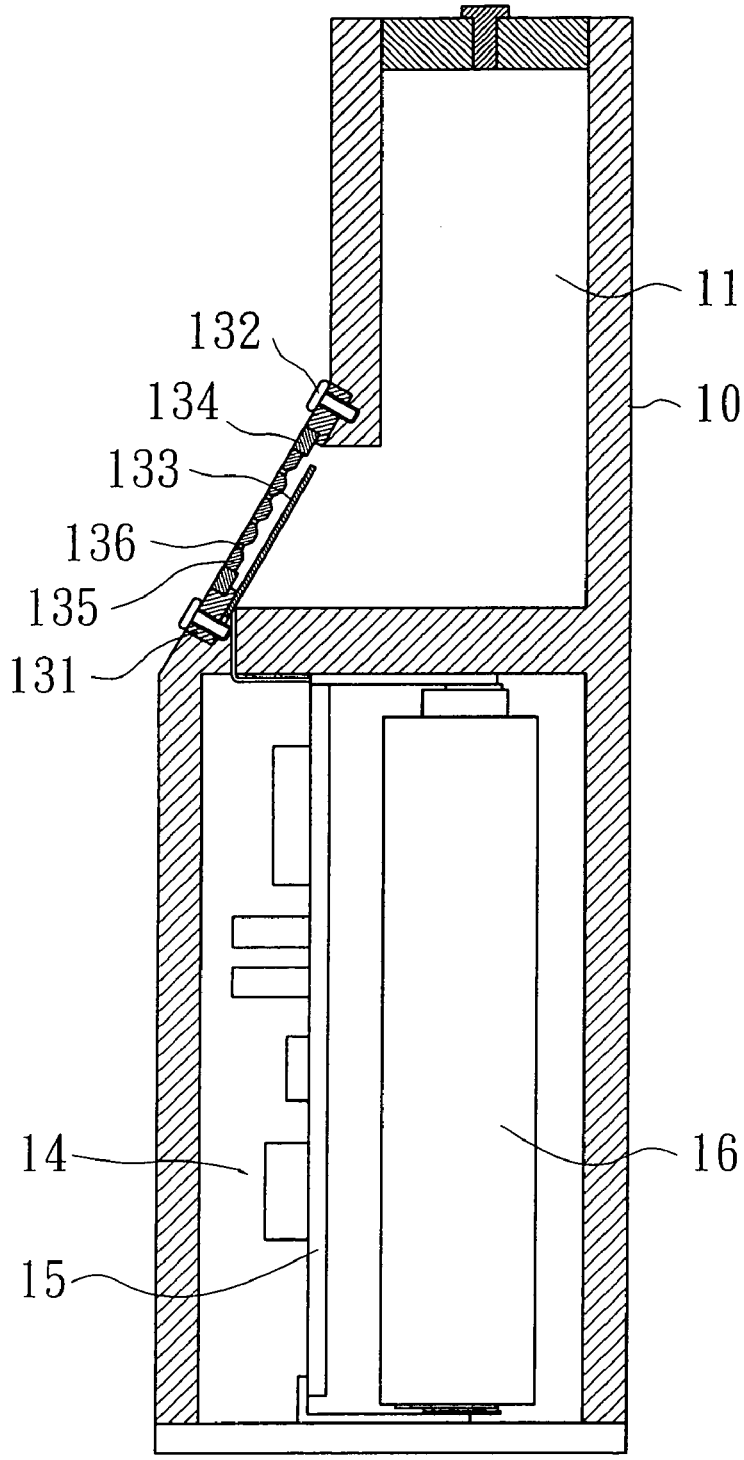
FIG. 4 is a sectional view of the assembled generator in FIG. 3.
Figure 5:
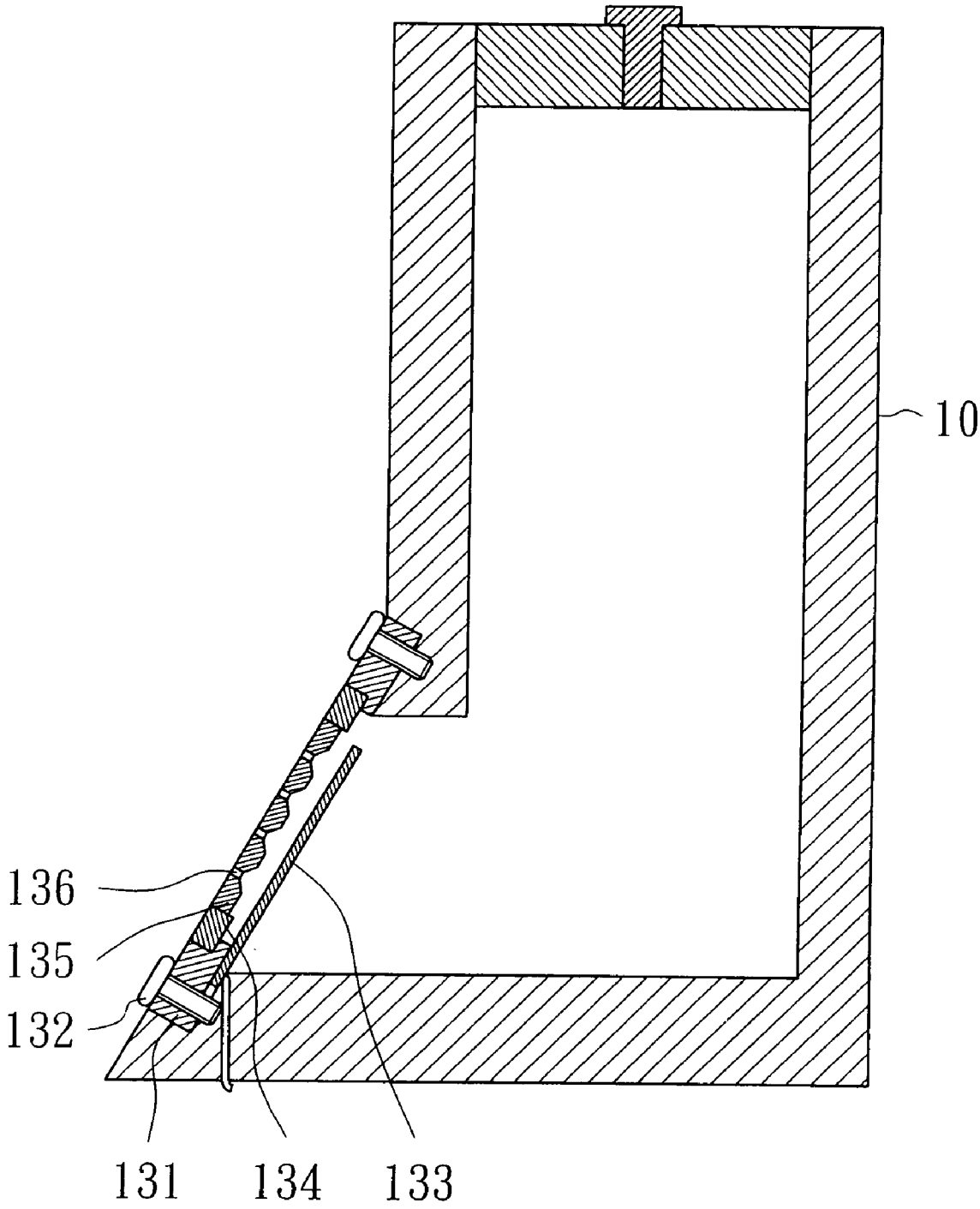
FIG. 5 is an enlarged sectional view of the upper portion of the generator shown in FIG. 3.

Referring to FIGS. 3 to 7, there is shown a portable micro droplet generator constructed in accordance with a preferred embodiment of the invention comprising a housing 10 including a lower space for containing a control panel 14, an IC based controller 15, and a battery 16 for providing power to the controller 15; and an upper chamber 11 for containing fluid medicine poured therein through a top fluid inlet 12. An oblique surface (i.e., nebulized area 13) is formed on the joining portion of the lower space and the upper chamber 11. On the nebulized area 13 there are provided an outer nozzle plate 135 having a plurality of tapered apertures 136 formed thereon, a hollow pad 134 with the nozzle plate 135 fixed thereon by adhesive, a frame 131 larger than the pad 134 for snugly fitting the pad 134 thereon, the frame 131 being secured to the housing 10 by driving two screws 132 through two upper corners of the frame 131 into the housing 10, and a cantilever piezoelectric element 133 having its lower side secured to both the frame 131 and the housing 10 by driving two screws 132 through two lower corners of the frame 131 and the piezoelectric element 133 into the housing 10. The piezoelectric element 133 is electrically coupled to the controller 15.

Each of the apertures 136 has a small outer opening and a large inner opening. The sizes of the openings decide the particle size of the spray to be generated by the generator. Advantageously, the invention has designed an optimum size of either opening. Note that the piezoelectric element 133 is provided in the innermost portion of the nebulized area 13 and the nozzle plate 135 is provided in the outermost portion thereof with the piezoelectric element 133 being spaced from the nozzle plate 135. Such configuration can form a very small deformation thereof during operation, resulting in good quality of generated droplets. Moreover, any malfunctioned component can be replaced individually so as to save the maintenance cost of the generator.

Figure 6:
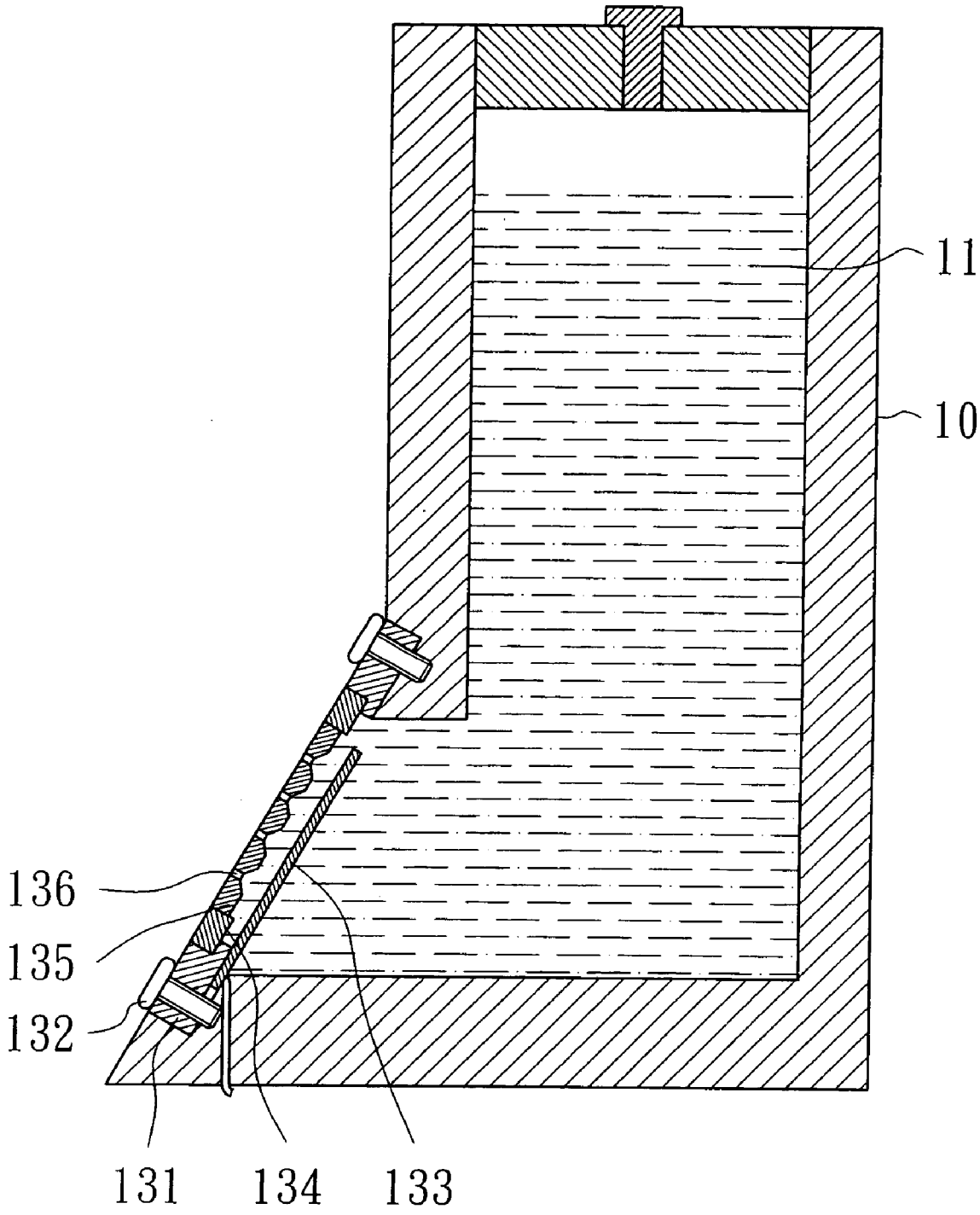
FIGS. 6 and 7 are views similar to FIG. 5 for illustrating the nebulization operations performed in the nebulized area of FIG. 5.
Figure 7:
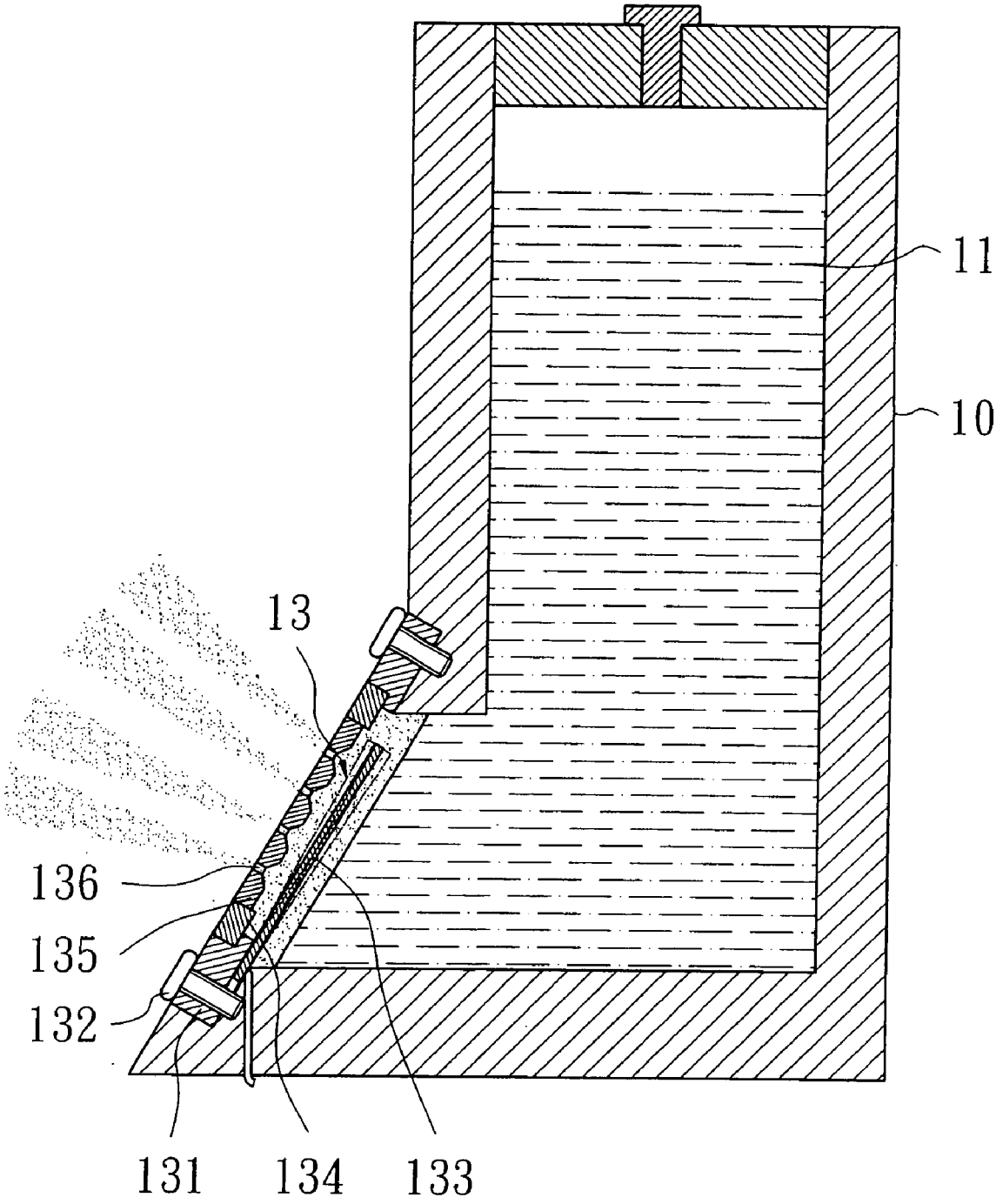

Referring to FIGS. 6 and 7 specifically, nebulization operations of the generator will be described in detailed below. Liquid medicine is filled in the nebulized area 13 prior to activation of the generator. the liquid medicine cannot pass 1 mm diameters of the apertures 136 because of its viscous force. Impulse signals are generated by an oscillating circuit of the controller 15 after energizing the generator. Further, a voltage pumping circuit of the controller 15 is enabled to vibrate the piezoelectric element 133. The vibrated piezoelectric element 133 is adapted to sufficiently mix the liquid medicine therearound for causing the pellets thereof to become smaller particles which can pass the apertures 136 freely (i.e., the apertures 136 are not clogged). As a result, fluid cavitation is developed to nebulized the liquid medicine forms a stream of droplets from smaller particles of the fluid medicine and ejects the same therefrom, condenses larger particles of the fluid medicine due to collision therebetween, and drops the condensed liquid into the fluid medicine. The provision of the pad 134 aims at lessening or absorbing the nebulizing pressure exerted upon the nozzle plate 135 for facilitating the nebulization. Further, the piezoelectric element 133 can decrease the frequency of oscillation so that the generator is able to produce an ejection of fluid droplets in a preferred low-frequency oscillation in addition to an undesired high-frequency oscillation which can consume much energy and thus generate high heat.

While the invention herein disclosed has been described by means of specific embodiments, numerous modifications and variations could be made thereto by those skilled in the art without departing from the scope and spirit of the invention set forth in the claims.

What is claimed is:

1. A micro droplet generating device comprising:

a lower space for containing a control panel; and an upper chamber for containing a fluid medicine and including a nebulized area;

wherein, in the nebulized area there are provided: (a) an outer nozzle plate including a plurality of tapered apertures each having a small outer opening and a large inner opening, and (b) a piezoelectric element electrically coupled to the control panel such that activating the piezoelectric element will vibrate the piezoelectric element to sufficiently mix the liquid medicine therearound for developing fluid cavitation in the nebulized area, form a stream of droplets from small particles of the fluid medicine and ejects the same therefrom, condense larger particles of the fluid medicine due to collision therebetween, and drop the condensed liquid into the fluid medicine;

said droplet generating further comprising a frame formed between the nozzle plate and the piezolelectric element, the piezoelectric element is cantilevered by driving one or more fasteners through lower sides of the frame and the piezoelectric element into the chamber.

2. The micro droplet generating device of claim 1, further comprising a fluid inlet formed on the upper chamber for permitting the fluid medicine to pour therein.

3. The micro droplet generating device of claim 1, wherein the control panel comprises an IC based controller for vibrating the piezoelectric element, and a battery for providing power to the controller.

4. A micro droplet generating device comprising:

a lower space for containing a control panel; and an upper chamber for containing a fluid medicine and including a nebulized area;

wherein, in the nebulized area there are provided: (a) an outer nozzle plate including a plurality of tapered apertures each having a small outer opening and a large inner opening, and (b) a piezoelectric element electrically coupled to the control panel such that activating the piezoelectric element will vibrate the piezoelectric element to sufficiently mix the liquid medicine therearound for developing fluid cavitation in the nebulized area, form a stream of droplets from small particles of the fluid medicine and ejects the same therefrom, condense larger particles of the fluid medicine due to collision therebetween, and drop the condensed liquid into the fluid medicine;

the micro droplet generating further comprising a hollow pad adhered to the nozzle plate for buffering so as to facilitate the droplet ejection.

5. The micro droplet generating device of claim 4, further comprising a fluid inlet formed on the upper chamber for permitting the fluid medicine to pour therein.

6. The micro droplet generating device of claim 4, wherein the control panel comprises an IC based controller for vibrating the piezoelectric element, and a battery for providing power to the controller.

* * * * *